United States Patent [19]

Jirasek

[11] 4,069,837

[45] Jan. 24, 1978

[54] WASHING MACHINE OVERFLOW CONTROL MEANS

[76] Inventor: James D. Jirasek, 109 S. 31st St., Temple, Tex. 76501

[21] Appl. No.: 669,676

[22] Filed: Mar. 23, 1976

[51] Int. Cl.[2] ..... E03C 1/12; H01H 35/24

[52] U.S. Cl. ..... 137/360; 68/208; 137/557; 137/560; 307/118

[58] Field of Search ..... 68/208; 137/217, 360, 137/519.5, 557, 560; 307/118

[56] References Cited

U.S. PATENT DOCUMENTS

| | | | |
|---|---|---|---|
| 2,852,034 | 9/1958 | Shames et al. | 137/217 |
| 3,091,111 | 5/1963 | Cruse et al. | 417/36 X |
| 3,661,174 | 5/1972 | Cripe | 137/519.5 X |
| 3,770,001 | 11/1973 | Davis | 137/217 |
| 3,862,433 | 1/1975 | Rousselet | 137/387 X |

*Primary Examiner*—Alan Cohan
*Assistant Examiner*—Gerald A. Michalsky
*Attorney, Agent, or Firm*—Richards, Harris & Medlock

[57] ABSTRACT

An overflow control unit for a washing machine which interconnects the drain hose of the washing machine to a stand-pipe is provided which comprises a cylindrical plug device having a central axially extending passageway therethrough and a by-pass valve interconnecting the passageway of the cylindrical plug with the atmosphere, the by-pass valve having an open and a closed position. In one embodiment the overflow control unit is operatively connected to a pressure switch so that upon a build-up of water pressure within the stand-pipe due to the drain being obstructed the switch is activated to break the electrical circuit to the washing machine.

15 Claims, 6 Drawing Figures

WASHING MACHINE OVERFLOW CONTROL MEANS

BACKGROUND OF THE INVENTION

This invention relates generally to a washing machine overflow control unit. More particularly, the invention relates to a washing machine overflow control valve which interconnects the drain hose of a washing machine to a stand-pipe of the drainage system. In one aspect, the invention relates to a washing machine overflow control valve which responds to an overflow condition in the drainage system to deactivate the washing machine.

Washing machines are presently in wide use in homes across the country. Most present day washing machines are of the automatic type which automatically cycle through various operations until the clothes are completely washed, rinsed, and partially dried. The drain tube of the washing machine through which the dirty water is disposed is usually inserted into a stand-pipe which, in turn, is coupled to the household drainage system. Problems have arisen, however, in the use of such automatic washing machines when the household drainage system becomes clogged for any reason. Upon such a happening, the stand-pipe will overflow and a large amount of water will be pumped out of the machine onto the floor and thus throughout a portion of the household to cause considerable damage.

Heretofore, numerous washing machine overflow control units and devices have been proposed by the prior art which would allow the housewife to employ the automatic washing machine and to leave same unattended without fear of drain overflow problems occurring. Some of such devices are shown in U.S. Pat. Nos. 3,862,433 and 3,091,111.

However, a need has long been recognized for a washing machine overflow control unit which can readily be incorporated into existing houses and which is reliable and simple in construction. Further, the need has been felt for an improved washing machine overflow control unit which could readily detect a pressure build-up within the drainage system to deactivate the washing machine without fear of overflowing or damage to the machine.

Accordingly, the present invention provides an improved washing machine overflow control unit which can readily be positioned within the stand-pipe of the drainage system without expensive modifications to same. Broadly, the washing machine overflow control means comprises a cylindrical plug device having a central axially extending passageway therethrough and a by-pass valve interconnecting the passageway of the cylindrical plug with the atmosphere. The by-pass valve is provided with an open and a closed position. Further, according to the invention, a washing machine overflow control means is provided which is operatively connected to a pressure switch so that upon a build-up of water pressure within the drainage system a switch is activated to break the electrical circuit to the washing machine.

DESCRIPTION OF THE DRAWINGS

A more complete understanding of the invention may be had by reference to the following detail description when taken in conjunction with the accompanying drawings wherein.

DESCRIPTION OF THE PREFERRED EMBODIMENTS

Figure 1:
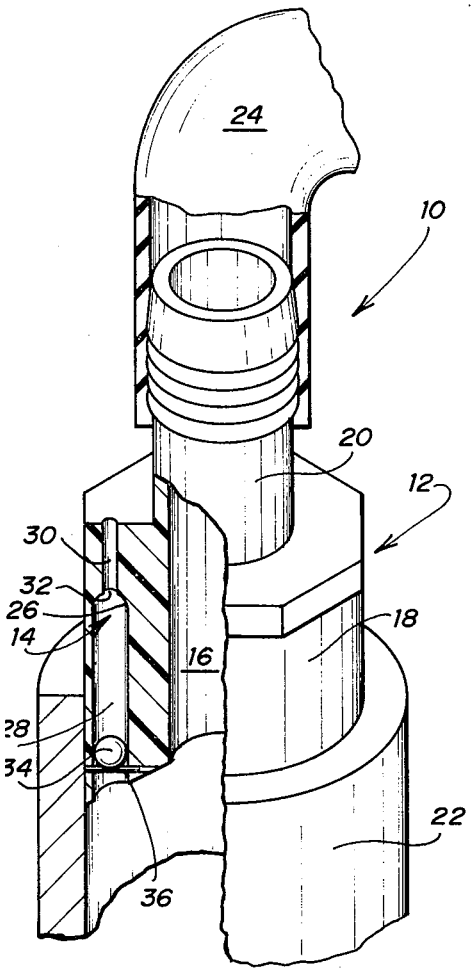
FIG. 1 is a partially broken perspective view of the washing machine overflow control means interconnecting the drain hose of a washing machine with the stand-pipe of the household drainage system.

Referring now to the drawings, and particularly to FIG. 1 thereof, there is shown an overflow control valve 10 comprising cylindrical plug means 12 and by-pass valve means 14. Cylindrical plug means 12 is provided with a central axially extending passageway 16 which allows substantially unrestricted movement of the water from the washing machine through cylindrical plug means 12. Cylindrical plug means 12 is further provided with an enlarged portion 18 and a reduced diameter portion 20. Enlarged portion 18 is positioned within and connected in a fluid-tight relationship with the upwardly extending end portion of stand-pipe 22. Reduced diameter end portion 20 is connected to washing machine drain hose 24 so that water from the washing machine can readily be passed through washing machine drain hose 24, central axially extending passageway 16 of cylindrical plug means 12, and stand-pipe 22 into the drainage system of the household, not shown.

By-pass valve means 14 positioned within a side wall of cylindrical plug means 12 interconnects central axially extending passageway 16 with the atmosphere so as to maintain atmospheric pressure within passageway 16 of cylindrical plug means 12 and thus stand-pipe 22 when the washing machine is not in a drain cycle or water pressure is not present in same due to a clogged drainage system. However, when the washing machine is in a drain cycle or the drainage system of the household is clogged, by-pass valve means 14 will be forced into a closed position thereby preventing overflow of water through by-pass valve means 14.

By-pass valve means 14 comprises a passageway 26 positioned within the side wall portion of cylindrical plug means 12, passageway 26 being positioned substantially parallel to central axially extending passageway 16. Passageway 26 is provided with a lower extending bore 28 and a upwardly extending bore 30 having a smaller diameter. Valve seat 32 is formed at the junction of lower extending bore 28 and upper extending bore 30 and a ball valve element 34 is positioned within lower extending bore 28. Pin member 36 traverses the lower end portion of lower extending bore 28 to maintain ball valve element 34 therein. Thus, the movement of ball valve element 34 within lower extending bore 28 is limited by pin member 36 when the valve is in an open position and by valve seat 32 when the valve is in closed position due to pressure build-up within stand-pipe 22.

Figure 2:
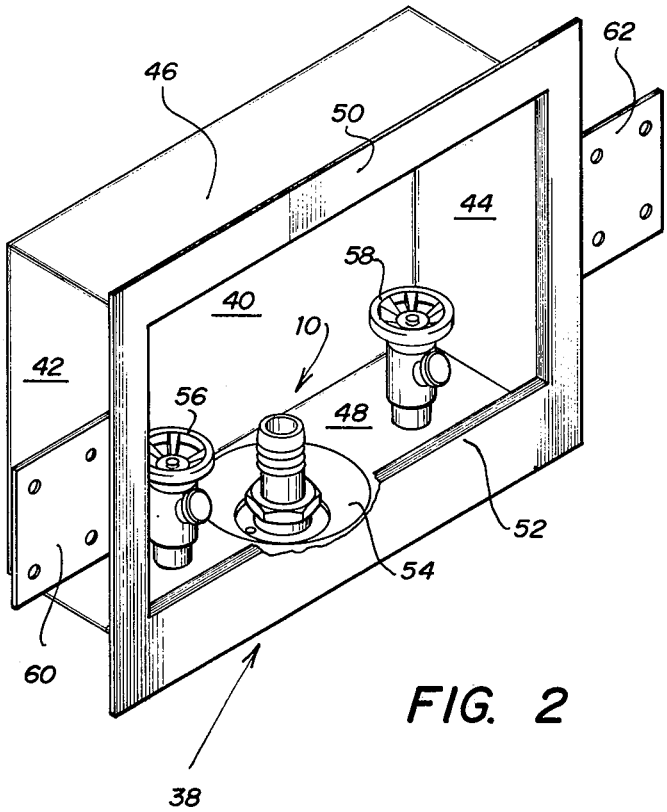
FIG. 2 is a partially broken perspective view of the washing machine overflow control means in combination with wall box.

Referring now to FIG. 2, in combination with FIG. 1, overflow control valve 10 is depicted in conjunction with side wall outlet box 38. Side wall outlet box 38 comprises back wall 40, side walls 42 and 44, top 46, and bottom 48. Top 46 preferably has downwardly extending lip 50 and bottom 48 has upwardly extending lip 52. Outlet box 38 has suitable connector means, such as outwardly extending lugs 60 and 62 secured to side walls 42 and 44 respectively, for connection of side wall outlet box 38 to a wall structure by suitable means such as nails, screws, and the like. Bottom 48 is further provided with an extending cup member 54 into which overflow control valve 10 is positioned. Cup member 54 allows dripping from faucets 56 and 58 to be collected therein and disposed into stand-pipe 22 through by-pass valve means 14 when the washing machine is not in its drain cycle. When cup member 54 is provided with an extension member for connecting to the upwardly extending end portion of stand-pipe 22, enlarged portion 18 of cylindrical plug member 12 will be sized to readily fit within the extension member of cup member 54. However, if cup member 54 is not provided with an extension for coupling to stand-pipe 22 cylindrical plug means 12 should be positioned within cup member 54 so as to allow enlarged portion 18 of cylindrical plug member 12 to be connected to the upwardly extending end portion of stand-pipe 22. Reduced diameter portion 20 of cylindrical plug means 12 is connected to washing machine drain hose 24.

Figure 3:
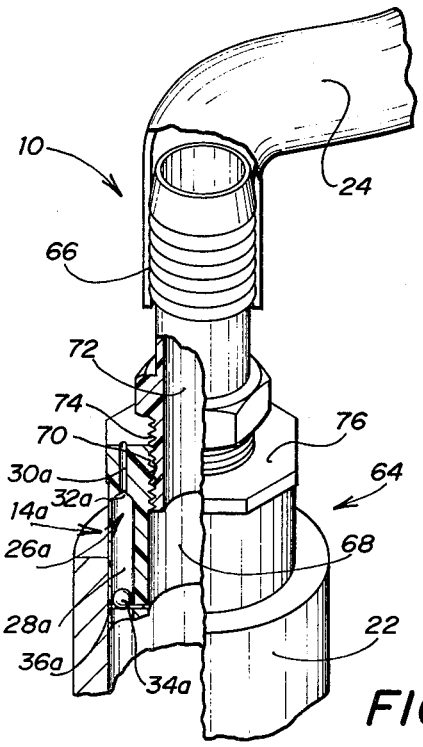
FIG. 3 is an enlarged perspective view of one embodiment of the washing machine overflow control means of the present invention.

Referring now to FIG. 3, overflow control valve 10 is depicted as a two-piece unit comprising annular plug means 64, adapter fitting means 66, and by-pass valve means **14*a*. Annular plug means 64 is provided with a central axially extending passageway 68 having a plurality of threads 70 disposed therein. Adapter fitting means 66 is provided with central axially extending passageway 72 and a plurality of external threads 74 for threadedly engaging adapter fitting means 66 within annular plug means 64 in a fluid-tight relationship. Annular plug means 64 is then connected to stand-pipe 22 and the upwardly extending end portion of adapter fitting means 66 is connected, in a fluid-tight relationship, with washing machine drain hose 24. As can be seen, the coupling of annular plug means 64 and adapter fitting means 66 provides shoulder 76. By-pass valve means 14*a* positioned within a side wall of annular plug means 64 interconnects passageway 68 of annular plug member 64 with the atmosphere through shoulder 76 so as to maintain atmospheric pressure within stand-pipe 22** when the washing machine is not in a drain cycle or water pressure is not present in same due to a clogged drainage system.

By-pass valve means **14*a* comprises a passageway 26*a* positioned within the side wall portion of annular plug means 64, passageway 26*a* being positioned substantially parallel to central axially extending passageway 68. Passageway 26*a* is provided with a lower extending bore 28*a* and an upwardly extending bore 30*a* having a smaller diameter. Valve seat 32*a* is formed at the junction of lower extending bore 28*a* and upper extending bore 30*a* and a ball valve element 34*a* is positioned within lower extending bore 28*a*. Pin member 36*a* traverses the lower end portion of lower extending bore 28*a* to maintain ball valve element 34*a* therein. Thus, the movement of ball valve element 34*a* within lower extending bore 28*a* is limited by pin member 36*a* when the valve is in an open position and by valve seat 32*a* when the valve is in a closed position due to pressure build-up within stand-pipe 22**.

Figure 5:
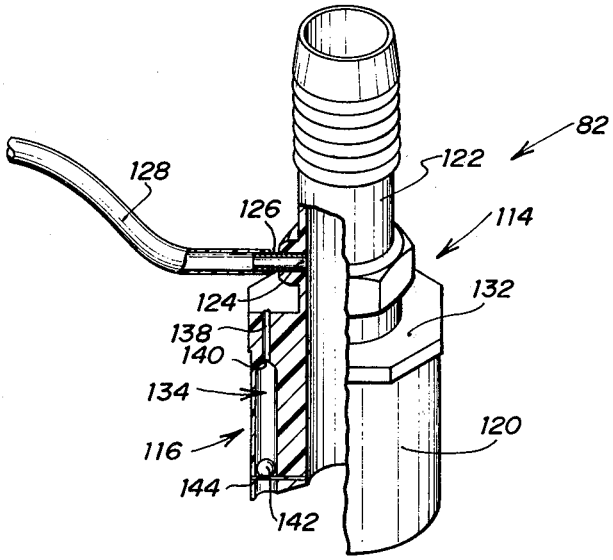
FIG. 5 is an enlarged partially broken perspective view of the washing machine overflow control means of FIG. 4; and, FIG. 6 is an electric circuit diagram of a pressure sensing control unit for use within the washing machine overflow control means of FIG. 5.
Figure 4:
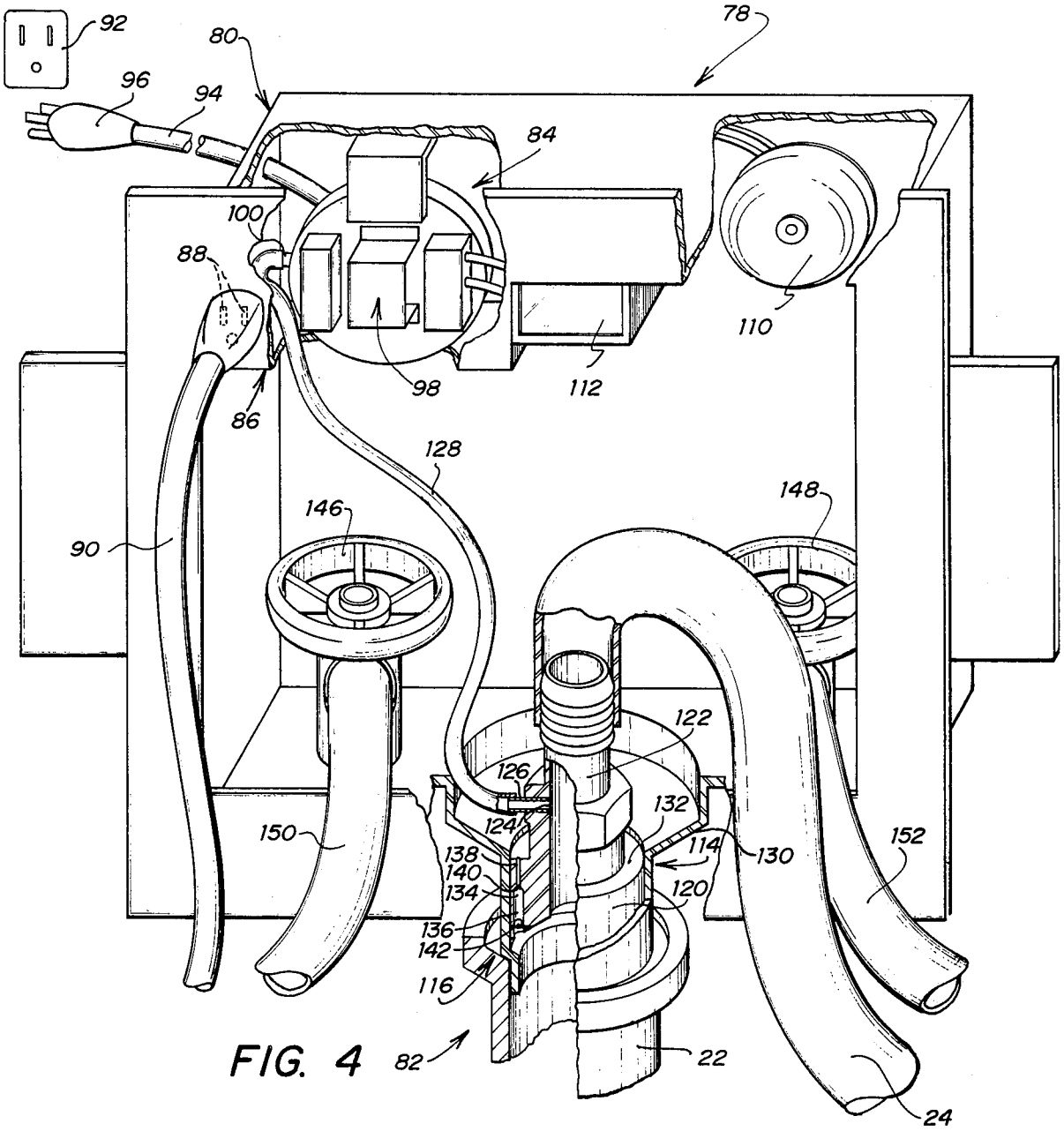
FIG. 4 is a partially broken perspective view of another embodiment of the washing machine overflow control means of the present invention employed in combination with a pressure responsive electrical switch to de-activate the washing machine.
Figure 6:
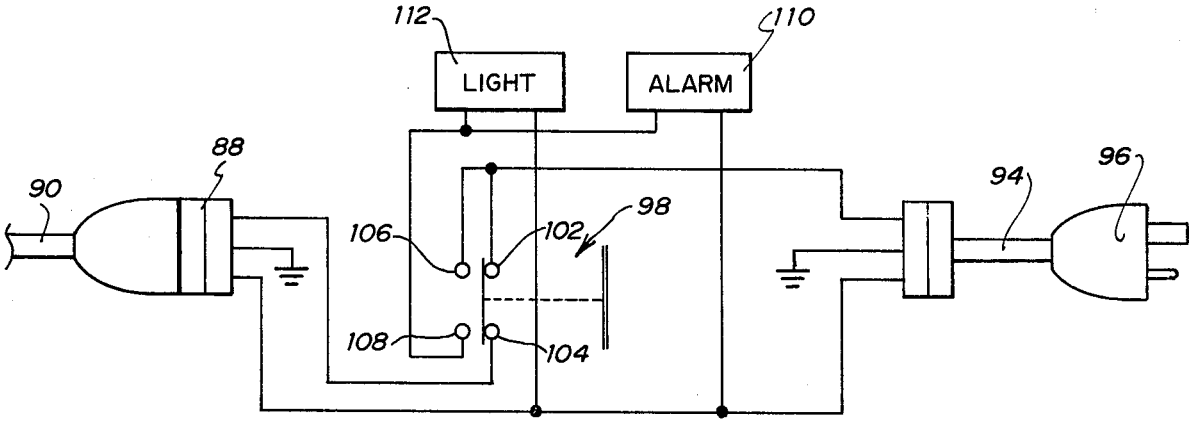

Referring now to FIGS. 4, 5 and 6, another embodiment of washing machine overflow control means of the present invention is depicted. In this embodiment, a washing machine overflow control means 78 comprises side wall outlet box 80 and overflow control valve 82 which is operatively connected to stand-pipe 22, washing machine drain hose 24 and pressure sensitive control unit 84. Pressure sensitive control unit 84 can be any unit which is known in the art, such as that disclosed in U.S. Pat. No. 3,091,111. Control unit 84 is provided with a housing 86 and includes a receptacle 88. The electric cord 90 for the washing machine (not shown) instead of being plugged directly into the electrical outlet 92 is plugged into receptacle 88 of pressure sensitive control unit 84. Pressure sensitive control unit 84 is provided with an energizing cord 94 which has a plug 96, plug 96 being plugged into electrical outlet 92.

Pressure sensitive control unit 84 includes a pressure responsive electric switch 98. Pressure sensitive control unit 84 is operatively connected to overflow control valve 82. Inlet tube 100 is mounted on housing 86, one end of tube 100 being adjacent pressure responsive electrical switch 98, the other end being connected to and in fluid communication with overflow control valve 82. Pressure responsive switch 98 includes a diaphragm which is actuated to actuate switch 98 when the water pressure within overflow control valve 82 and thus inlet tube 100 exceeds a predetermined pressure.

Pressure responsive electric switch 98 includes a pair of normally closed contacts 102 and 104 which are caused to open when water pressure in inlet tube 100 is detected or exceeds a predetermined pressure. Pressure responsive electrical switch 98 may also include a pair of normally open contacts, 106 and 108, which close when pressure in inlet tube 100 is detected or exceeds a predetermined pressure. Electric alarm units, such as bell 110 and/or light 112 may be connected, in series, with the pair of normally open contacts 106 and 108 so that upon water pressure being detected or exceeding a predetermined amount in inlet tube 100 not only is the washing machine shut off by the opening of contacts 102 and 104 but an alarm system is activated by the closing of contacts 106 and 108 to inform the housewife of the situation.

Overflow control valve 82 can be of a unitary construction or a two piece construction, such as described with reference to FIG. 3. However, for the sake of simplicity such will be described as a unitary member. Overflow control valve means 82 comprises cylindrical plug means 114 and by-pass valve means 116. Cylindrical plug means 114 is provided with a central axially extending passageway 118 which allows substantially unrestricted movement of water from the washing machine through cylindrical plug means 114. Cylindrical plug means 114 is further provided with an enlarged portion 120 and a reduced diameter portion 122. Passageway 124 traverses a sidewall of reduced diameter portion 122 of cylindrical plug means 114 so as to intersect central axially extending passageway 118 and provide fluid communication therebetween. Tubular outlet member 126 is secured within passageway 124 and the external end portion of tubular member 126 is connected to and in fluid communication with tubular inlet member 100 of pressure sensitive control unit 84 by any suitable means, such as conduit 128. Enlarged portion 120 of cylindrical plug means 114 is positioned within cup member 130 of wall outlet box 80 so that shoulder 132, formed at the junction of enlarged portion 120 and reduced diameter portion 122 forms a bottom or base member within cup member 130. Cup member 130 is thereafter positioned within and connected in a fluid-tight relationship with the upwardly extending end portion of stand-pipe 22. The end portion of reduced diameter end portion 122 is connected to washing machine drain hose 24 so that water from the washing machine can readily be passed through washing machine drain hose 24, central axially extending passageway 118 of cylindrical plug means 114, and stand-pipe 22 into the drainage system of the household.

By-pass valve means 116, which interconnects central axially extending passageway 118 of cylindrical plug means 114 with the atmosphere through shoulder 132, comprises a passageway 134 positioned within the side wall portion of enlarged portion 120 of cylindrical plug means 114, passageway 130 being positioned substantially parallel to central axially extending passageway 118. Passageway 134 is provided with a lower extending bore 136 and an upwardly extending bore 138, said upwardly extending bore having a reduced diameter. Valve seat 140 is formed at the junction of lower extending bore 136 and upwardly extending bore 138 and a ball valve element 142 is positioned within lower extending bore 136. Pin member 144 traverses the lower end portion of lower extending bore 136 to maintain ball valve element 142 therein. Thus, the movement of the ball valve element 142 within lower extending bore 136 is limited by pin member 144 when the valve is in an open position and by valve seat 140 when the valve is in a closed position due to pressure build-up within stand-pipe 22. When overflow valve control means 82 is positioned within the lower portion of cup member 130 water drippings from faucets 146 and 148, to which the water inlet hoses 150 and 152 of the washing machine are connected, are collected within cup member 130 and drained into stand-pipe 22 through by-pass valve means 116 when the washing machine is not in its drain cycle or the drainage system is not clogged.

The invention herein described readily provides a simple and inexpensive washing machine overflow control means which can readily be installed in existing stand-pipes and connected to the drain hose of a washing machine. Further, when desired, a simple and inexpensive control unit can be installed which will de-energize the washer, should a stoppage occur in the drain system. Further, the use of the present invention serves to prevent costly damage due to overflowing of a washing machine when a stoppage condition in the drainage system arises. Thus, while particular embodiments of the invention have been shown and described, modifications may be made, and it is intented in the claims to cover such modifications as fall within the spirit and scope of the invention.

Having thus described the invention, I claim:

1. An overflow control valve for connecting a washing machine drain hose to a stand-pipe comprising:

a. cylindrical plug means having a central axially extending passageway therethrough, one end of said plug means being connected to the upwardly extending end portion of the stand-pipe, the other end of said plug means being connected to the drain hose of the washing machine; and, b. by-pass valve means positioned within a sidewall of said cylindrical plug means, said by-pass valve means having an open position for connecting said axially extending passageway with the atmosphere when said washing machine is not in a drain cycle and a closed position when said washing machine is in a drain cycle.

2. The overflow control valve of claim 1 wherein said cylindrical plug means is provided with an enlarged portion at one end thereof for connecting same to said stand-pipe and a reduced diameter portion at the opposite end thereof for connecting said plug means to said drain hose and which includes shoulder means formed by the interconnection of said enlarged portion with said reduced diameter portion, said by-pass valve means interconnecting said passageway within said enlarged portion with the atmosphere through said shoulder means.

3. The overflow valve of claim 2 wherein said by-pass valve means comprises a ball valve element positioned with a second passageway formed in said enlarged end portion, said second passageway being substantially parallel to said central axially extending passageway, said second passageway having a lower extending bore and an upwardly extending bore, said upwardly extending bore having a reduced diameter, a valve seat formed at the junction of said lower and upwardly extending bores, and a stop means traversing the lower end portion of said lower extending bore for maintaining said ball valve element therein.

4. The overflow valve of claim 3 wherein said cylindrical plug means comprises an annular plug means having a central axially extending passageway therethrough, said by-pass valve means being formed within a sidewall of said annular plug, threads disposed within said passageway of said annular plug, adapter fitting means having a central axially extending passageway therethrough, and threads on a portion of the external surface of said adapter fitting means for threadedly engaging said adapter fitting means within said annular plug means.

5. A washing machine overflow control unit for connecting a washing machine drain hose to a stand-pipe comprising:

a. a wall mounted outlet box having a drain therein, said drain being connected to and in fluid communication with the stand-pipe;

b. a cylindrical plug means having a central axially extending passageway therethrough, said plug means being positioned within the said box and having an upwardly extending end portion connected to the drain hose of said washing machine, said plug means further being provided with by-pass valve means in the side wall thereof having an open position for connecting said passageway with the atmosphere when said washing machine is not in a drain cycle and having a closed position when said washing machine is in a drain cycle;

c. pressure sensing means operably connected to said plug means and in fluid communication with said central axially extending passageway;

d. a power circuit including a normally closed switch means connected to said sensing means and adapted to be opened when pressure in said passageway extends above a given level; and e. socket means operably connected through said switch means to said power circuit to apply power to said washing machine when said switch means is closed.

6. The overflow control unit of claim 5 wherein said control valve means is provided with an enlarged portion at one end thereof for positioning in said drain and a reduced diameter portion at the oppposite end thereof for connecting to said drain hose and which includes shoulder means formed by the interconnection of said enlarged portion with said reduced diameter portion, said by-pass valve means interconnecting the passageway within said enlarged portion with the atmosphere through said shoulder means.

7. The overflow control unit of claim 6 wherein said reduced diameter portion is provided passageway traversely disposed to the axis of the central axially extending passageway, and includes conduit means sealed within said passageway and connected at its other end to said pressure sensing means.

8. The overflow control unit of claim 7 wherein said by-pass valve means comprises a ball valve element positioned within a third passageway formed in said enlarged end portion, said third passageway being substantially parallel to said central axially extending passageway, said third passageway having a lower extending bore and an upwardly extending bore, said upwardly extending bore having a reduced diameter, a valve seat formed at the junction of said lower and said upwardly extending bores, and stop means traversing the lower end portion of said lower bore for maintaining said ball valve element therein.

9. The overflow control unit of claim 8 wherein said control valve means comprises an annular plug means having a central axially extending passageway therethrough, said by-pass valve means being formed within a sidewall of said annular plug, threads disposed within said passageway of said annular plug, adapter fitting means having a central axially extending passageway therethrough, and threads on a portion of the external surface of said adapter fitting means for threadedly engaging said adapter fitting means within said annular plug.

10. The overflow control unit of claim 9 which includes audio and visual signal means operably connected to said pressure sensing means.

11. The overflow control unit of claim 10 wherein said pressure sensing means, and said switch means are encased in a housing member secured with said wall mounted outlet box.

12. In a washing machine overflow control unit for connecting a washing machine drain hose to a stand-pipe wherein said unit is provided with a pressure sensing means operatively connected to a control means for deactivating the washing machine when a pressure build-up is detected within the drainage system, the improvement being a control valve means comprising a cylindrical plug means having a first central extending passageway therethrough, one end of said cylindrical plug means being connected in a fluid-tight relationship, to the upwardly extending end portion of said stand-pipe, the other end of said cylindrical plug means being connected in a fluid-tight relatinship, to the drain hose of the washing machine; by-pass valve means positioned within a side wall of said cylindrical plug means, said by-pass valve means having an open position for connecting said first central axially extending passageway of said cylindrical plug means with the atmosphere when said washing machine is not in a drain cycle and a closed position when said washing machine is in a drain cycle; a second passageway transversely disposed within the side wall portion of said cylindrical plug means and intersecting said first central axially extending passageway; and, conduit means sealably connected at one end thereof to said second passageway and sealably connected at its other end to said pressure sensing means to provide fluid communication between the first central axially extending passageway of said cylindrical plug means and said pressure sensing means.

13. The washing machine overflow control unit of claim 12 wherein said cylindrical plug means is provided with an enlarged portion at one end thereof for connection to said stand-pipe and a reduced diameter portion at the opposite end thereof for connection to said drain hose and which includes shoulder means formed by the interconnection of said enlarged portion with said reduction diameter portion, said by-pass valve means interconnecting said first central axially extending passageway within the enlarged portion with the atmosphere through said shoulder means.

14. The washing machine overflow control unit of claim 13 wherein said by-pass valve means comprises a ball valve element positioned within a third passageway formed in said enlarged end portion, said third passageway being substantially parallel to said first central axially extending passageway, said third passageway having a lower extending bore and an upwardly extending bore, said upwardly extending bore having a reduced diameter, a valve seat formed at the junction of said lower and said upwardly extending bores, and stop means traversing the lower end portion of said lower bore for maintaining said ball valve element therein.

15. The washing machine overflow control unit of claim 14 wherein said cylindrical plug means comprises an annular plug means and an adapter fitting means, said annular plug means forming said enlarged end portion and said adapter fitting means forming said reduced diameter portion, said annular plug means and said adapter fitting means operably connected to form said first central axially extending passageway and wherein said second passageway is positioned within said adapter fitting means.

* * * * *